US005163352A

United States Patent [19]

Yoshino

[11] Patent Number: 5,163,352

[45] Date of Patent: Nov. 17, 1992

[54] CYLINDER CONTROL UNIT

[75] Inventor: Kazunori Yoshino, Kobe, Japan

[73] Assignee: Shin Caterpillar Mitsubishi Ltd., Tokyo, Japan

[21] Appl. No.: 769,836

[22] Filed: Oct. 2, 1991

[30] Foreign Application Priority Data

Oct. 26, 1990 [JP] Japan ..... 2-112894[U]

[51] Int. Cl.[5] ..... F15B 11/08; F15B 13/04

[52] U.S. Cl. ..... 91/420; 51/435; 51/439; 137/614.2

[58] Field of Search ..... 91/415, 416, 421, 436, 91/433, 437, 420, 438, 439, 443; 137/614.2

[56] References Cited

U.S. PATENT DOCUMENTS

| | | | |
|---|---|---|---|
| 3,272,085 | 9/1966 | Hajma | 91/420 |
| 3,795,178 | 3/1974 | Roche | 91/420 |
| 3,857,404 | 12/1974 | Johnson | 91/420 X |
| 3,906,991 | 9/1975 | Haussler | 91/420 X |
| 3,933,167 | 1/1976 | Byers, Jr. | 91/420 X |
| 3,987,705 | 10/1976 | Strassheimer | 91/416 |
| 4,244,275 | 1/1981 | Smilges | 91/420 |
| 4,323,095 | 4/1982 | Acerbi | 91/420 X |

FOREIGN PATENT DOCUMENTS 1-156254 10/1989 Japan .

*Primary Examiner*—Edward K. Look
*Assistant Examiner*—Hoang Nguyen

[57] ABSTRACT

A buffer valve for a cylinder control unit includes a cylinder having first and second plungers each axially slidable in the cylinder with an intermediate piston disposed between the plungers and slidable in the cylinder with springs urging the plungers in the direction of the intermediately located piston; separate chambers are provided in the cylinder between the piston and the first and second plungers and second chambers are provided on the side of the plungers facing away from the piston; passages are provided in the first and second plungers for communicating between the first and second chambers on opposite sides of each plunger; a bypass passage connecting the first chambers for each plunger is provided with a check valve for allowing flow in only one direction from the first chamber of the first plunger to the first chamber of the second plunger so that when one of the plungers closes off communication between the bypass passage and the cylinder control unit, the check valve will prevent flow from the first chamber of the second piston.

2 Claims, 5 Drawing Sheets

CYLINDER CONTROL UNIT

BACKGROUND OF THE INVENTION

The present invention relates to a hydraulic cylinder control unit, and in particular such a unit capable of preventing a piston from sliding backwards in a cylinder to prevent an oscillation of a vehicle including the piston and cylinder therein, wherein the oscillation is generally caused by an inversion of surge pressure in the cylinder which inversion occurs when the hydraulic cylinder suddenly stops.

RELATED ART STATEMENT

An example of a cylinder control circuit for controlling a hydraulic cylinder, such as a boom cylinder, is Japanese Utility Model Public Disclosure No. 1-156254. With reference to FIGS. 1 to 3 of the Disclosure, each oil passageway is communicated through a buffer valve in the boom cylinder control circuit. The buffer valve is provided therein with a first and a second plunger on both of which a pressure in a cylinder-head acts. When the cylinder-head pressure increases instantaneously and then decreases because of inertia, the second plunger starts to operate delayed a little due to the function of a constriction. Thus, a cylinder-head chamber is caused to communicate instantaneously with a rod chamber via a check valve, so that an inversion of hydraulic surge pressure, which occurs when the boom cylinder makes a sudden stop, can be reduced.

OBJECT AND SUMMARY OF THE INVENTION

However, in the case of a single rod cylinder, since a pressurized area in a rod chamber is smaller than a pressurized area in a cylinder-head chamber, extremely high pressure generates in the rod chamber even if a pressurized fluid is arranged to flow from the cylinder-head chamber to the rod chamber. Accordingly, it is not possible to perform a primary object, that is, to reduce an inversion of the hydraulic surge pressure.

It is therefore the object of the present invention to provide a cylinder control unit capable of preventing an inversion of surge pressure which is generated when a hydraulic cylinder makes a sudden stop.

According to the present invention, a cylinder control unit includes a buffer valve. The buffer valve includes: a cylinder; a first plunger and a second plunger each of which is axially slidable in the cylinder; an intermediate piston slidable in the cylinder, the piston being interposed between the first plunger and the second plunger; a first and a second urging means for urging the first and second plungers towards the piston; first chambers formed in the cylinder between the piston and the first and second plungers; second chambers formed in the cylinder between bottom surfaces of the cylinder and the first and second plungers; passages provided in the first and second plungers for communicating between the first chambers and the second chambers; and a check valve for allowing a fluid to flow only in the direction from the first chamber of the first plunger to the first chamber of the second plunger. When the first or second plunger slides towards the piston and comes in contact with the cylinder, the plunger prevents the communication between the first chamber and the second chamber.

The cylinder control unit in accordance with the invention further includes a first passageway for communicating between the first chamber of the first plunger and a rod chamber of the cylinder, the first passageway having a larger cross-sectional area than the passages; a second passageway for communicating between the first chamber of the second plunger and a cylinder-head chamber of the cylinder, the second passageway having a larger cross-sectional area than the passages; and a pump for selectively supplying pressurized fluid to either the rod chamber of the cylinder and the first passageway or the cylinder-head chamber of the cylinder and the second passageway.

In a preferred embodiment, a branch way is provided to communicate the upstream of the check valve with a reservoir containing the pressurized fluid therein, and a fixed constriction is provided in the branch way.

The above object and advantageous features of the present invention will be made apparent from the following explanation made with reference to the accompanying drawings.

BRIEF DESCRIPTION OF THE DRAWINGS

FIG. 5 is a graph illustrating sequential pressure changes in a cylinder as times go by.

DESCRIPTION OF THE PREFERRED EMBODIMENTS

Figure 1:
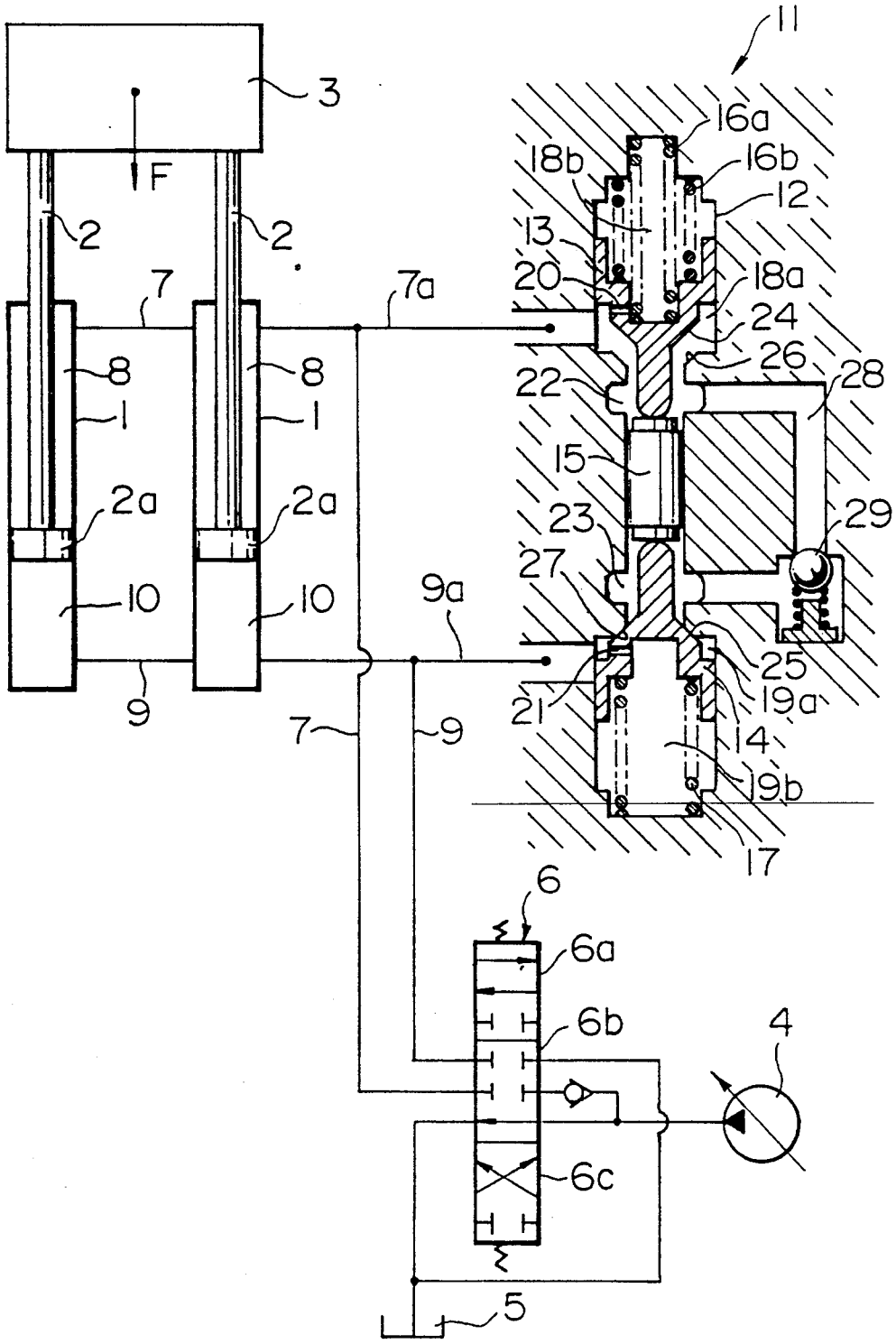
FIGS. 1 to 4 are schematic views illustrating sequential operations of a cylinder control unit in accordance with the invention.

FIG. 1 illustrates an embodiment of a cylinder control unit in accordance with the invention.

A boom cylinder 1 receives a certain amount of load 3 at an end of a cylinder-rod 2. The gravitational force caused by the load 3 is directed in the direction indicate by an arrow F. The cylinder-rod 2 is provided at its other end with a piston 2*a*. The cylinder-rod 2 is capable of sliding in the boom cylinder 2 and is caused to move by a pressurized hydralulic fluid.

A pump 4 supplies a pressurized oil to the boom cylinder 1 from a reservoir 5 through a control valve 6. More particularly, the pressurized oil is selectively supplied from the reservoir 5 via the control valve 6 to either a cylinder-rod chamber 8 of the cylinder 1 through a first oil passageway 7 or a cylinder-head chamber 10 of the cylinder 1 through a second oil passageway 9.

The cylinder-rod chamber 8 of the cylinder 1 is in communication with a buffer valve 11 through a first branch way 7*a* which diverges from the first oil passageway 7, and similarly the cylinder-head chamber 10 of the cylinder 1 is in communication with the buffer valve 11 through a second branch way 9*a*.

The buffer valve 11 has a first plunger 13 and a second plunger 14 both of which are capable of sliding axially in a cylinder 12. An intermediate piston 15 is interposed between the first and second plungers 13, 14, and is capable of sliding in the cylinder 12 together with both plungers 13 and 14. The first plunger 13 is urged towards the intermediate piston 15 by two springs 16*a* and 16*b*, and similarly the second plunger 14 is urged towards the piston 15 by a spring 17. The urging force by the springs 16*a*, 16*b*, 17 keeps the both plungers 13, 14 in contact with the intermediate piston 15. Generally, the pressure in the cylinder-head chamber 10 is higher than the pressure in the cylinder-rod chamber 8 due to the gravitational force caused by the load 3. For this reason, the urging force by the springs 16*a* and 16*b* is arranged to be larger than the urging force by the spring 17.

In the cylinder 12, a first chamber 18*a* is formed between the first plunger 13 and the piston 15, and a second chamber 18*b* is formed between the first plunger 13 and an end surface of the cylinder 12. Similarly, a first chamber 19*a* is formed between the second plunger 14 and the piston 15, and a second chamber 19*b* is formed between the second plunger 14 and an opposite end surface of the cylinder 12. The first chamber 18*a* is in communication with the cylinder-rod chamber 8 through the first branch way 7*a*, and the first chamber 19*a* is in communication with the cylinder-head chamber 10 through the second branch way 9*a*. The first and second plungers 13, 14 are provided with first and second passages 20, 21 as response time determining devices, respectively. The first passage 20 communicates the first chamber 18*a* with the second chamber 18*b* and the second passage 21 communicates the first chamber 19*a* with the second chamber 19*b*. These two passages 20 and 21 are arranged to have a much smaller cross-sectional area than the first and second branch ways 7*a* and 9*a*.

In the cylinder 12, first and second annularly recessed portions 22 and 23 are formed in communication with the first chambers 18*a* and 19*a*, respectively. The first and second plungers 13 and 14 are provided with first and second tapered surfaces 24 and 25 respectively. These tapered surfaces 24 and 25 of the plungers 13 and 14 come to in contact with first and second tapered seats 26 and 27 formed on the cylinder 12, when the first or second plunger 13, 14 slides towards the intermediate piston 15. When the first tapered surface 24 contacts with the first seat 26, the first chamber 18*a* is prevented from communicating with the first annularly recessed portion 22, and similarly, when the second tapered surface 25 contacts with the second seat 27, the first chamber 19*a* is prevented from communicating with the second annularly recessed portion 23. FIG. 1 illustrates the case where the second tapered surface 25 of the second plunger 14 contacts with the second seat 27 and so the first chamber 19*a* is prevented form communicating with the second recessed portion 23. However, it should be noted that although either the first or second tapered surfaces can contact with the associated seat, both of the tapered surfaces cannot contact with the associated seats at the same time.

The first annularly recessed portion 22 is in communication with the second annularly recessed portion 23 via a passageway 28 in which a check valve is provided. The check valve 29 allows a pressurized oil to flow only in the direction from the first recessed portion 22 to the second recessed portion 23.

The operation of the cylinder control unit is as follows.

Figure 5:
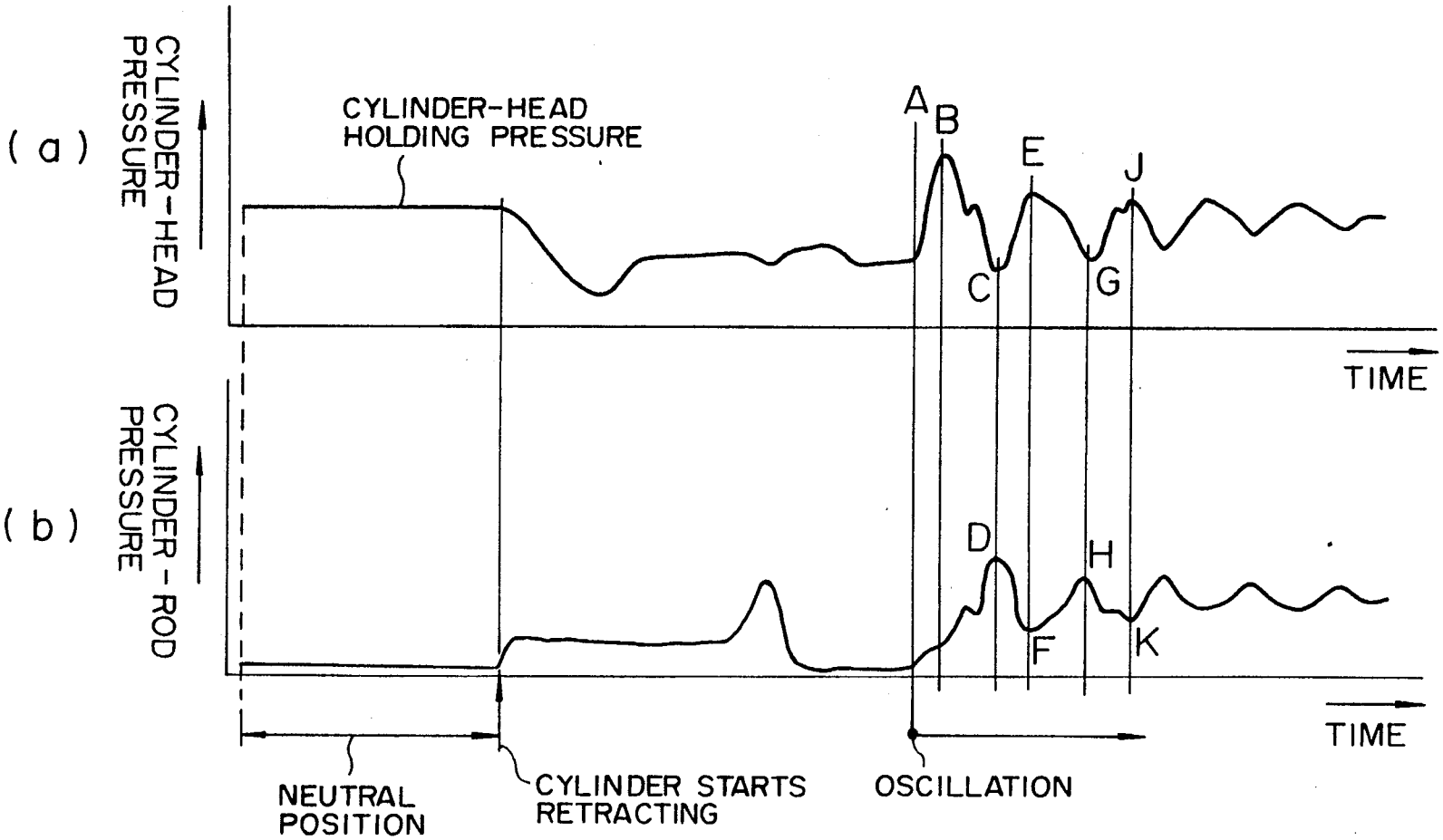

When the control valve 6 takes a neutral position 6*b*, as shown in FIG. 5*a*, a cylinder-head holding pressure is generated in the cylinder-head chamber 10 due to the gravitational force caused by the load 3. Then, when the control valve 6 is changed in position to a cylinder-retract postion 6*a*, the cylinder-head holding pressure starts decreasing, and thus the boom cylinder 1 starts retracting. When the position of the control valve 6 returns to the neutral 6*b*, as shown at a point A in FIG. 5*a*, in the cylinder-head chamber 10, a back pressure caused by inertial load increases rapidly and reaches a maximum value B. However, since the pressure in the cylinder-head chamber 10 at the point B is higher than the cylinder-head holding pressure, the pressure in the cylinder-head chamber 10 starts decreasing rapidly at the point B and reaches a minimum value C. At the time the cylinder-head pressure reaches the point C, the pressure in the cylinder-rod chamber 8 reaches a maximum value D which is in antiphase with the point B. The pressure in the cylinder-rod chamber 8 starts reducing at the point D, and then repeats increasing and decreasing. That is, the cylinder-rod chamber pressure oscillates periodically.

When the cylinder-head holding pressure is generated in the cylinder-head chamber 10, the cylinder-head holding pressure communicates with the second chamber 19*b* through the second passage 21 in the buffer valve 11. Thus, the combination of two forces, one of which is caused by the cylinder-head holding pressure and acts on an axially projected area of the second seat 27, the other is the urging force caused by the spring 17, overcomes the urging force caused by the springs 16*a* and 16*b*, and so the second tapered surface 25 of the second plunger 14 comes into contact with the second seat 27. Thus, the pressurized oil supplied from the cylinder-head chamber 10 is sealed hermetically in the second chamber 19*b*.

Figure 2:
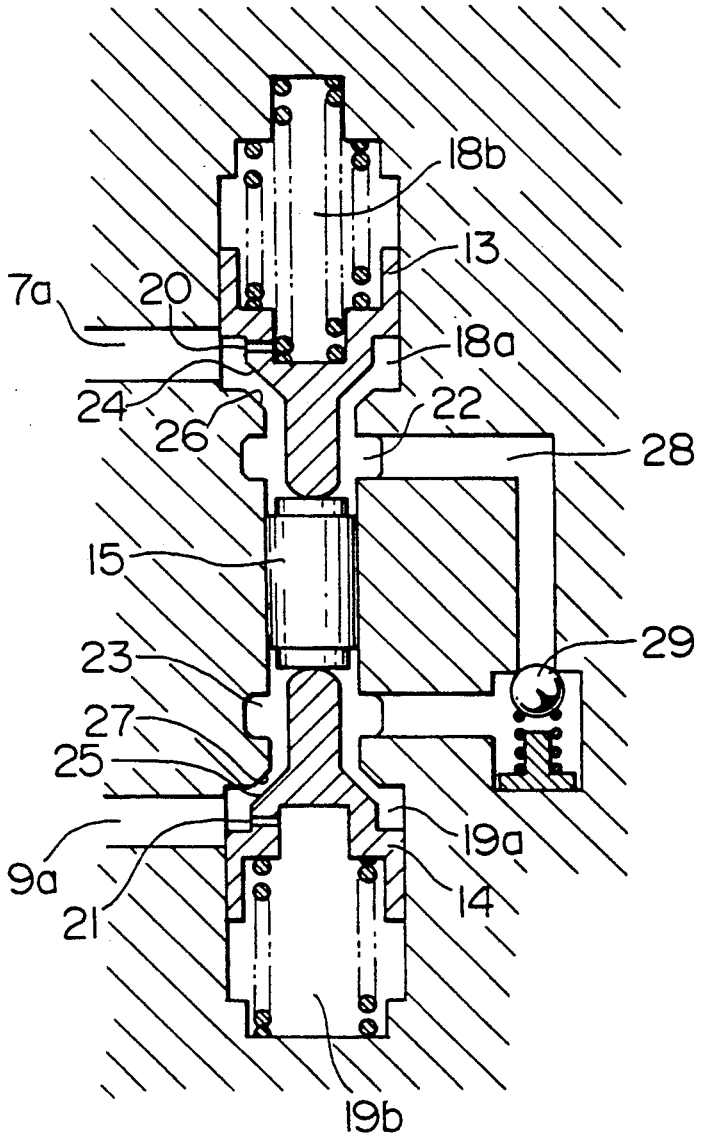

When the boom cylinder 1 starts retracting and the control valve returns to the neutral position 6*b*, as shown FIG. 5*a*, the pressure in the cylinder-head chamber 10 starts increasing rapidly and reaches a maximum value E. And then, the cylinder-head pressure decreases rapidly to reach a minimum value G. At, that time, the pressure in the cylinder-rod chamber 8 reactively reaches a maximum value H and communicates the second chamber 18*b* of the first plunger 13 through the first passage 20. Thus, as shown in FIG. 2, the first plunger 13 overcomes the urging force caused by the spring 17 and so makes the second plunger 14 slide downwards via the intermediate piston 15. During this operation, since the pressurized oil in the second chamber 19*b* is gradually discharged through the second passage 21, the second plunger 14 does not slide down straight, so that a transition period is generated while the pressurized oil is discharged through the second passage 21, as shown in FIG. 2. That is, in the transition period, neither the first nor second tapered surfaces 24, 25 of the both plungers 13, 14 contacts the first or second seat 26, 27. In the transition period, the high pressure in the cylinder-rod chamber 8 communicates sequentially with the first chamber 18*a*, the first annularly recessed portion 22, the check valve 29, the second annularly recessed portion 23, the first chamber 19*a*, the second branch way 9*a*, and finally the cylinder-head chamber 10 which is at a lower pressure. Accordingly, the period in which the periodical oscillation wave as shown in FIG. 5*a* continues can be shortened.

Figure 3:
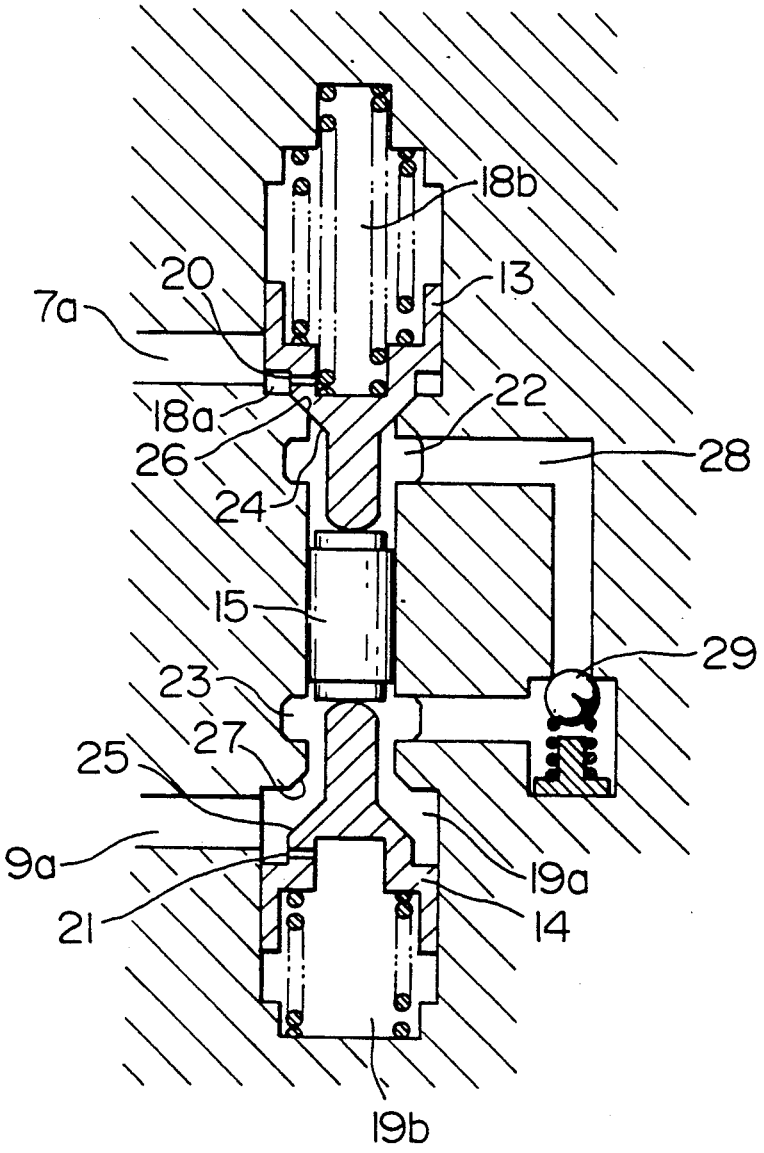

When a vehicle is lifted up by means of a front structure secured to the tip of the boom cylinder 1, the pressure caused by a load is generated in the cylinder-rod chamber 8. However, as shown in FIG. 3, since the first tapered surface 24 of the first plunger 13 is made to be held against the first seat 26, the pressurized oil in the cylinder-rod chamber 8 is inhibited from flowing to the second plunger 14 through the first branch way 7*a*.

Figure 4:
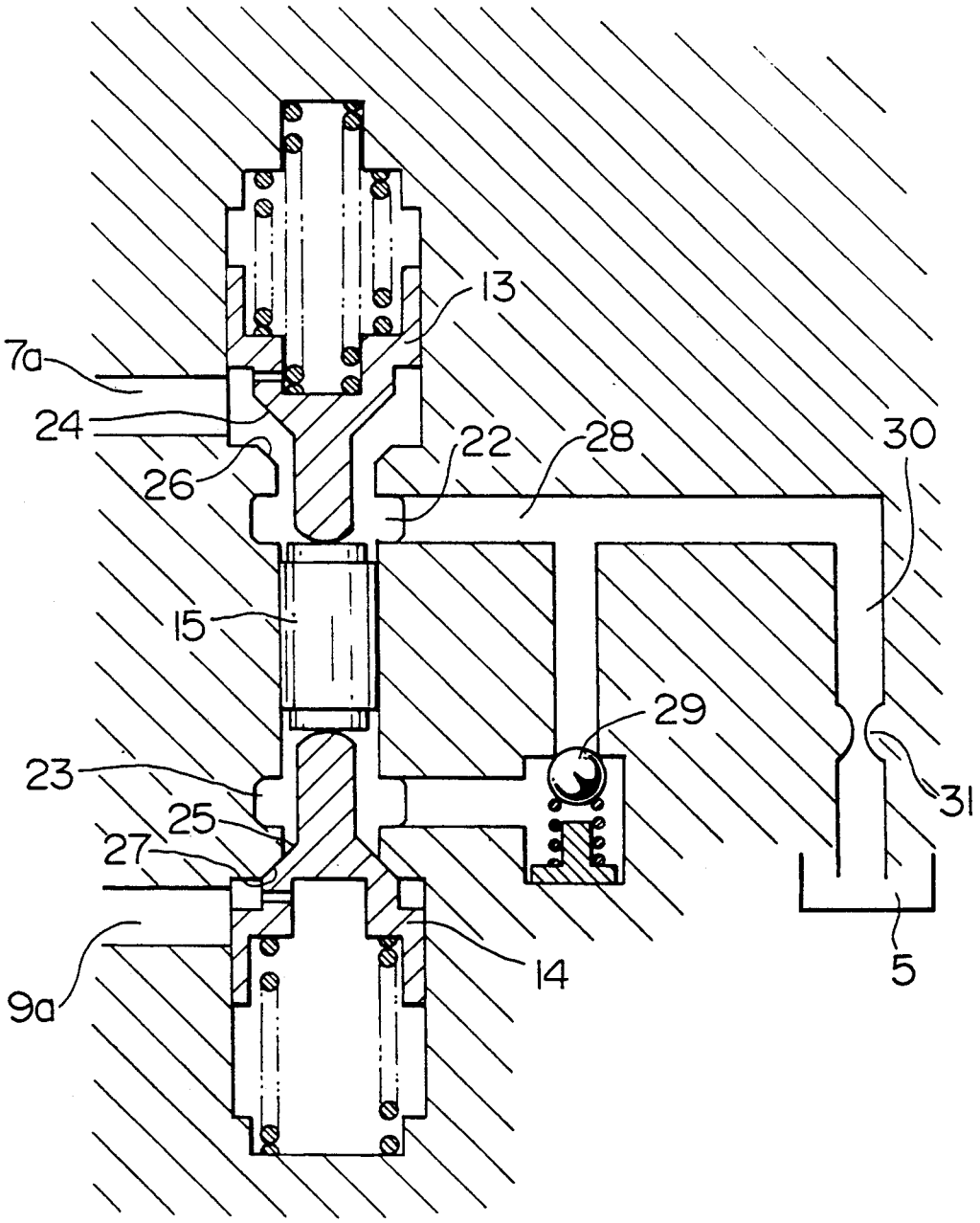

Further, when the boom cylinder 1 extends against a load, a high pressure generates in the cylinder-head chamber 10, so that the second tapered surface 25 of the second plunger 14 is made to contact the second seat 27, as shown in FIG. 4. Thus, the pressurized oil is not circulated to the cylinder-rod chamber 8 from the cylinder-head chamber 10.

In order to rapidly reduce the minimum value of the pressure in the cylinder-rod chamber 8, a fixed constriction 31 may be provided in a branch way 30 which communicates the passageway 28 with the reservoir 5.

As described above with respect to the preferred embodiment, in the cylinder control unit in accordance with the invention, a high pressure in a cylinder-head chamber is prevented from being generated when a cylinder stops moving, and so the periodical oscillation which occurs after the cylinder stops moving can be supressed early. Accordingly, it is possible to prevent a body of a vehicle from oscillating.

While the present invention has been described in connection with the preferred embodiments, it will be understood that it is not intended to limit the invention to these embodiments. On the contrary, it is intended that the present invention cover all alternatives, modifications, and equivalents as may be included within the spirit and scope of the invention as defined by the attached claims.

What is claimed is:

1. A cylinder control unit comprising:

a buffer valve, said buffer valve comprising: a cylinder; a first plunger and a second plunger each of which is axially slidable in the cylinder; and intermediate piston slidable in the cylinder, said piston being interposed between the first and second plungers; a first and a second urging means for urging the first an second plungers towards the piston; first chambers formed in the cylinder between the piston and the first and second plungers; second chambers formed in the cylinder between bottom surfaces of the cylinder and the first anc second plungers; passages provided in the first anc second plungers for communicating between th first chambers and the second chambers; and a check valve for allowing a fluid to flow only in th direction from the first chamber of the first plunge to the first chamber of the second plunger, eacl said plunger having a valve seat associated there with and being movable between a first postio where said respective plunger is spaced from saic respective valve seat and a second position wher said respective plunger engages said respectiv valve seat to thereby prevent communication be tween the first chamber and the second chamber, a first passageway for communicating between th first chamber of the first plunger and a cylinder-roc chamber of the cylinder, said first passageway hav ing a larger cross-sectional area than the passages a second passageway for communicating between th first chamber of the second plunger and a cylinder head chamber of the cylinder, said second passage way having a larger cross-sectional area than th passages; and a pump for selectively supplying pressurized fluic either the rod chamber of the cylinder and the firs passageway or the cylinder-head chamber of th cylinder and the second passageway.

2. A cylinder control unit in accordance with claim 1 wherein a branch way is provided to communicate th upstream of the check valve with a reservoir containin the pressurized fluid therein, and wherein a fixed con striction is provided in the branch way.

* * * * *